US008541708B2

(12) United States Patent
Chenier

(10) Patent No.: US 8,541,708 B2
(45) Date of Patent: Sep. 24, 2013

(54) BUTTON SWITCH

(75) Inventor: Christian Chenier, Drummondville (CA)

(73) Assignee: General International Mfg (Co) Ltd., Quebec (CN)

( * ) Notice: Subject to any disclaimer, the term of this patent is extended or adjusted under 35 U.S.C. 154(b) by 216 days.

(21) Appl. No.: 13/039,439

(22) Filed: Mar. 3, 2011

(65) Prior Publication Data

US 2012/0222943 A1 Sep. 6, 2012

(51) Int. Cl.
*H01H 3/16* (2006.01)

(52) U.S. Cl.
USPC ..... 200/552; 200/526; 200/334; 200/341; 200/333

(58) Field of Classification Search
USPC ..... 200/334, 552, 526
See application file for complete search history.

(56) References Cited

U.S. PATENT DOCUMENTS

| | | | | |
|---|---|---|---|---|
| 4,389,550 | A * | 6/1983 | Reiter | 200/43.13 |
| 5,280,148 | A * | 1/1994 | Cummins | 200/524 |
| 5,954,191 | A * | 9/1999 | Reiter | 200/332 |
| 6,621,028 | B1 * | 9/2003 | Bartok | 200/529 |
| 2005/0252759 | A1 * | 11/2005 | Ichimaru | 200/523 |

* cited by examiner

*Primary Examiner* — Edwin A. Leon
*Assistant Examiner* — Ahmed Saeed
(74) *Attorney, Agent, or Firm* — Ming Chow; Sinorica, LLC

(57) ABSTRACT

A button switch includes a main body. The main body includes a switch member therein. The switch member has a start portion and a stop portion to connect with a start button and a stop button, respectively. The stop button has a first position and a second position. In a normal state, the stop button is located at the first position and doesn't drive the stop portion. When the stop button is at the second position, the stop button will drive the stop portion. Thus, the operator is enforced to press the stop button again and the stop button is returned to the first position to start the switch member, preventing the operator to press the start button unexpectedly to start the switch member.

8 Claims, 8 Drawing Sheets

BUTTON SWITCH

BACKGROUND OF THE INVENTION

1. Field of the Invention

The present invention relates to a button switch.

2. Description of the Prior Art

A button switch is widely used to switch on/off a machine. A conventional button switch is composed of a button portion and a switch portion. The button switch can be a type of single button or a type of multiple buttons according to the number of the buttons on the button portion. The type of single button means the button portion only has a button. When in use, the user can press the button to switch on the switch portion and press the button again to switch off the switch portion. The type of multiple buttons means the button switch has at least one start button and one stop button which are used to start and stop the switch portion.

No matter what type of button switch, it has the shortcoming to restart the machine. This may cause an accident. For example, when the working machine is stopped for emergent maintenance, the operator may touch the start button unexpectedly, which results in damage of the working machine or injury of the operator. Accordingly, the inventor of the present invention has devoted himself based on his many years of practical experiences to solve this problem.

SUMMARY OF THE INVENTION

The primary object of the present invention is to provide a button switch which comprises a main body, a start button and a stop button. The main body comprises a switch member. The switch member has a start portion and a stop portion. The start button is disposed on the main body to drive the start portion. The stop button is disposed on the main body to drive the stop portion. The stop button has a first position and a second position. In a normal state, the stop button is located at the first position and doesn't drive the stop portion. When the stop button is pressed the first time, the stop button is moved from the first position to the second position to drive the stop portion. When the stop button is pressed the second time, the stop button is returned to the first position.

The button switch of the present invention enforces the operator to press the stop button again after the stop button is pressed the first time, so that the stop button is returned to the first position and then the start button is pressed to start the switch member, preventing the operator to press the start button unexpectedly.

DETAILED DESCRIPTION OF THE PREFERRED EMBODIMENTS

Figure 1:
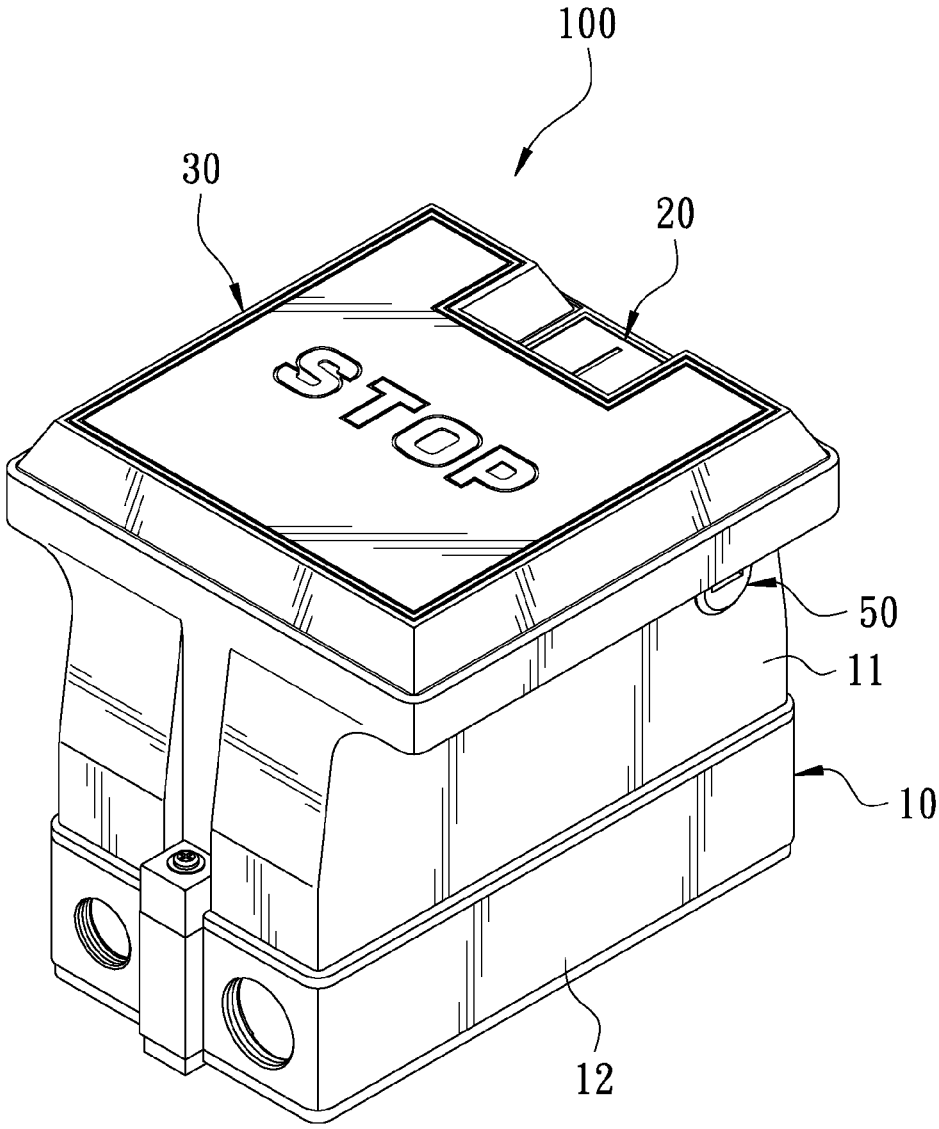
FIG. 1 is a perspective view according to a preferred embodiment of the present invention.
Figure 2:
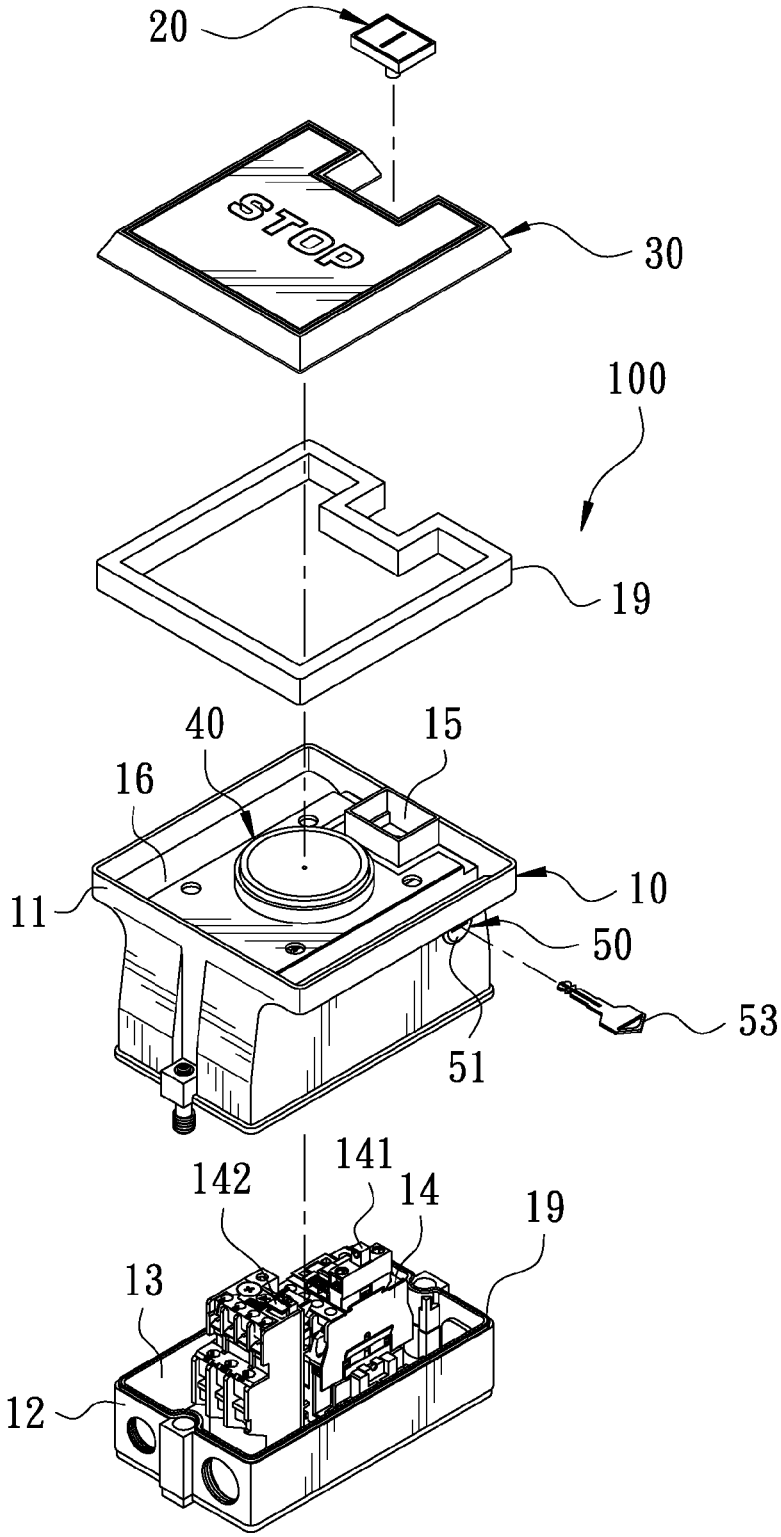
FIG. 2 is an exploded view according to the preferred embodiment of the present invention.
Figure 3:
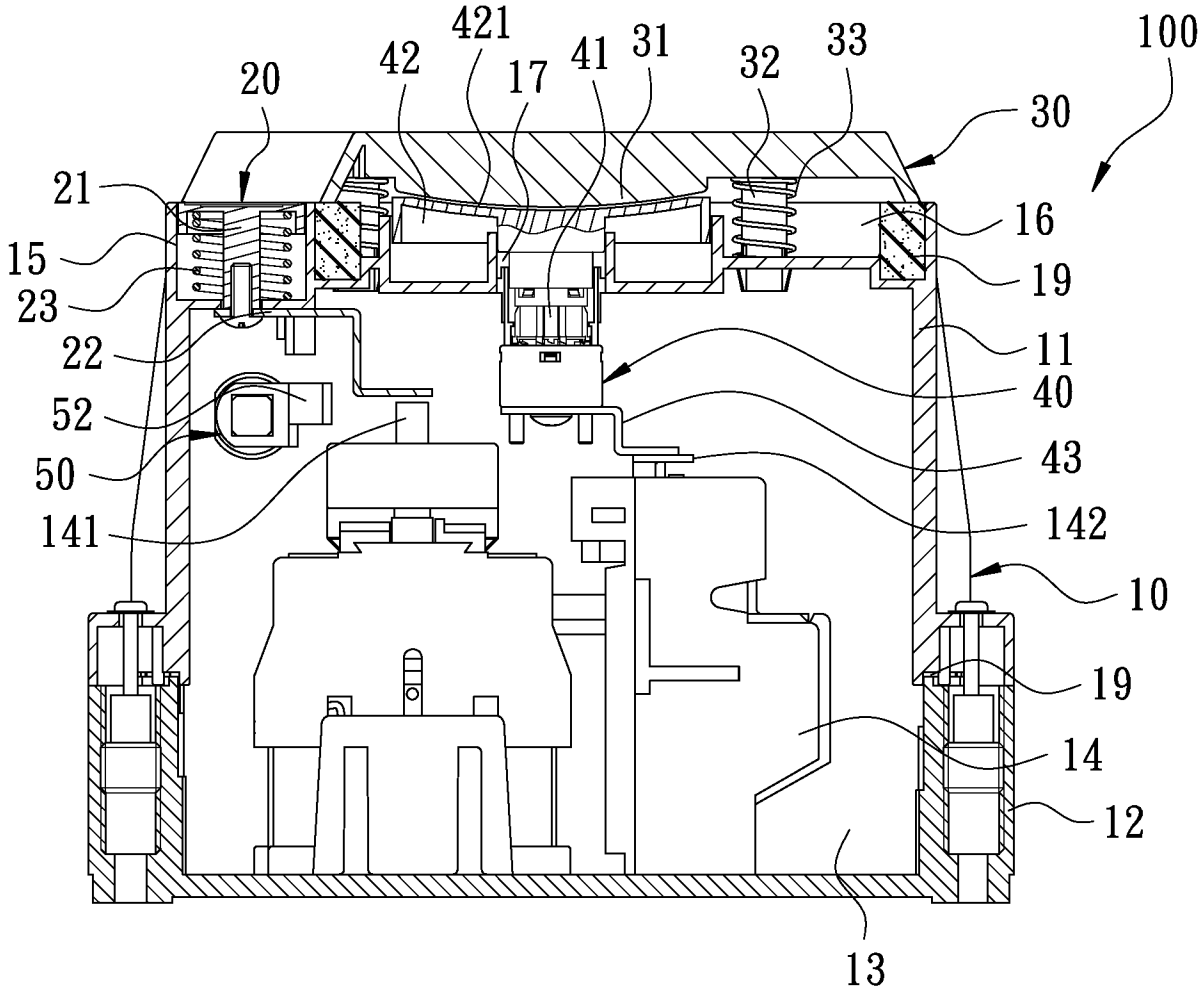
FIG. 3 is a cross-sectional view according to the preferred embodiment of the present invention.

Embodiments of the present invention will now be described, by way of example only, with reference to the accompanying drawings.

As shown in FIG. 1 to FIG. 4, a button switch 100 according to a preferred embodiment of the present invention comprises a main body 10, a start button 20, an outer casing 30, a stop button 40, and a limit unit 50.

The main body 10 comprises an upper part 11, a lower part 12, a chamber 13 between the upper part 11 and the lower part 12, and a switch member 14 received in the chamber 13. The switch member 14 has a start portion 141 and a stop portion 142 to start and stop the switch member 14, respectively. When the stop portion 142 is activated, the start portion 141 is unable to start the switch member 14. The upper part 11 has a top end formed with a first recess 15 and a second recess 16. The upper part 11 further has an accommodation trough 17 at a central portion thereof and a through hole 18 in the bottom of the accommodation trough 17. The main body 1 further comprises a seal ring 19 on the periphery of the second recess 16 as well as at the junction of the upper part 11 and the lower part 12.

The start button 20 is disposed in the first recess 15, and comprises a protruding pole 21 extending from the bottom thereof and inserting in the main body 10. The protruding pole 21 is connected with a start member 22. The start member 22 has one end which is located opposite to the protruding pole 21 and against the start portion 141 of the switch member 14 for driving the start portion 141 of the switch member 14. A spring 23 is provided between the start button 20 and the first recess 15, so that the start button has a homing function.

The outer casing 30 is disposed in the second recess 16 of the main body 10 and on top of the stop button 40. The outer casing 30 has a bottom provided with a protrusion 31 close to the stop button 40 and a plurality of circular poles 32. Each circular pole 32 is fitted with a spring 33 and elastically against the stop button 40.

Figure 4:
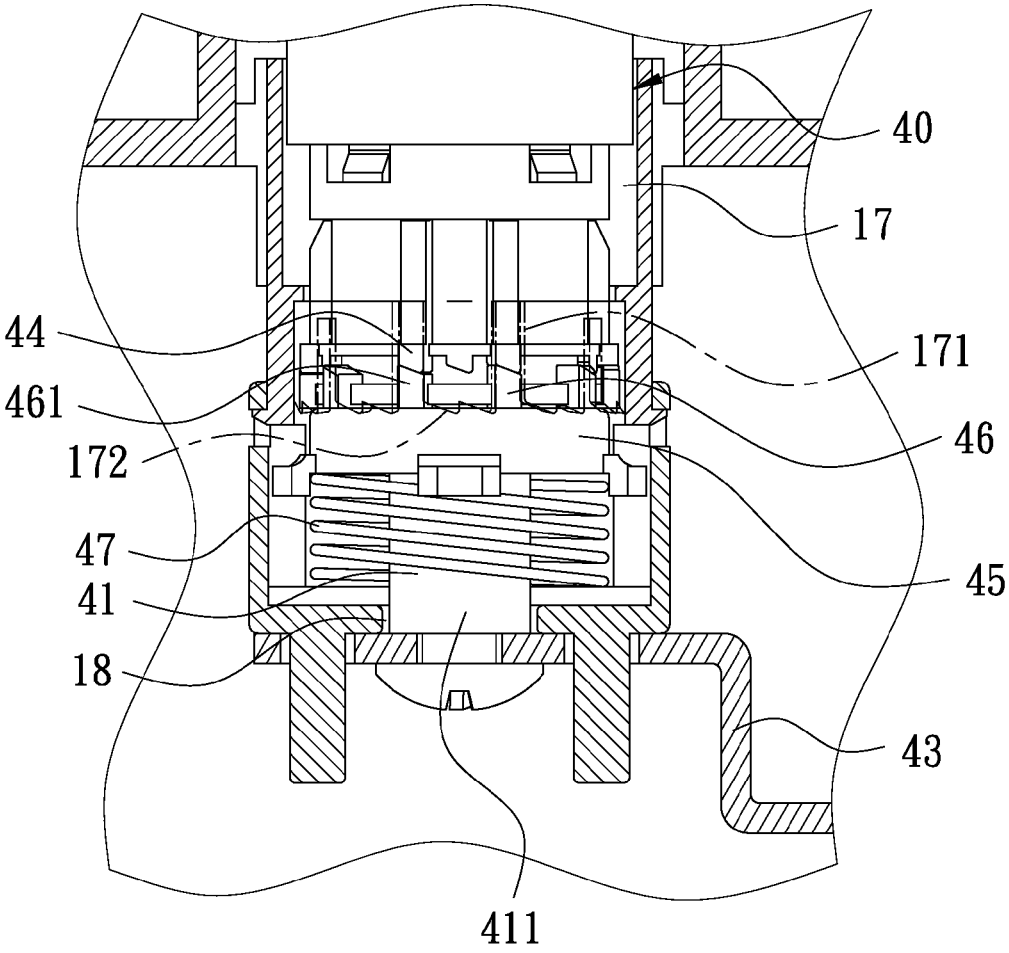
FIG. 4 is an enlarged sectional view showing the stop button in the first position according to the preferred embodiment of the present invention.
Figure 5:
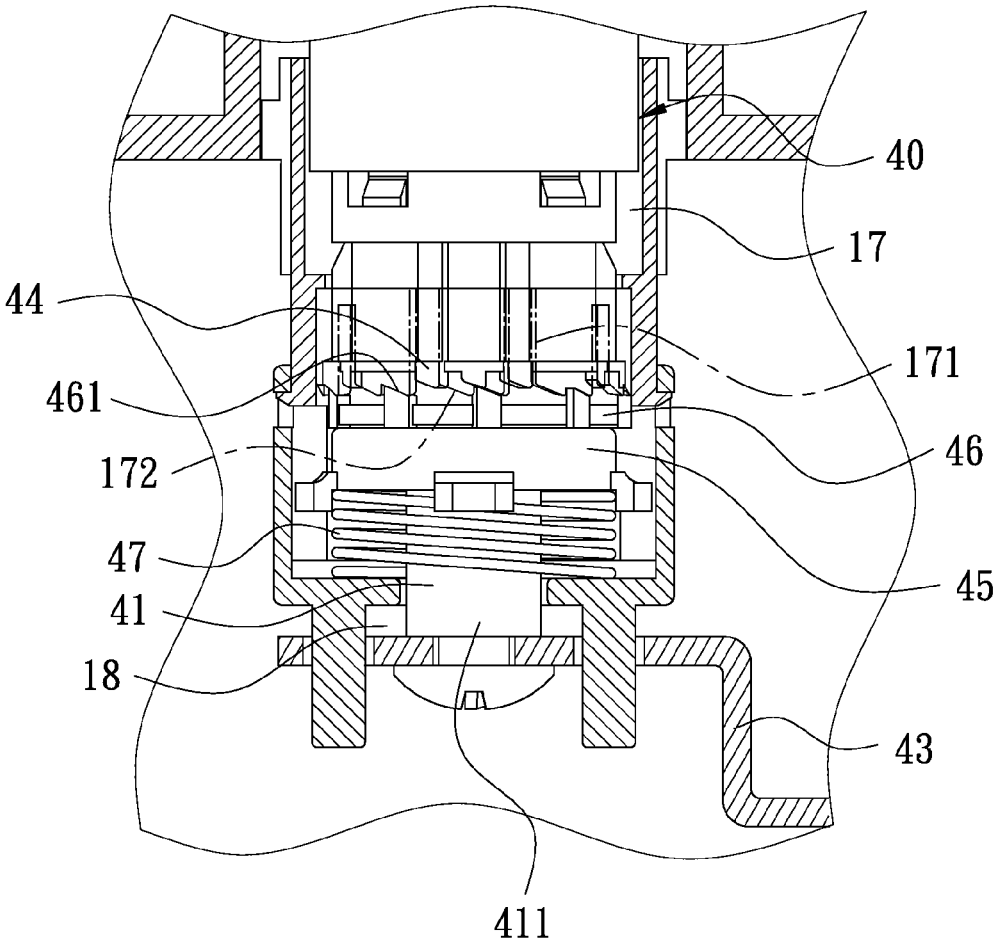
FIG. 5 is an enlarged sectional view showing the stop button in the second position according to the preferred embodiment of the present invention.
Figure 6:
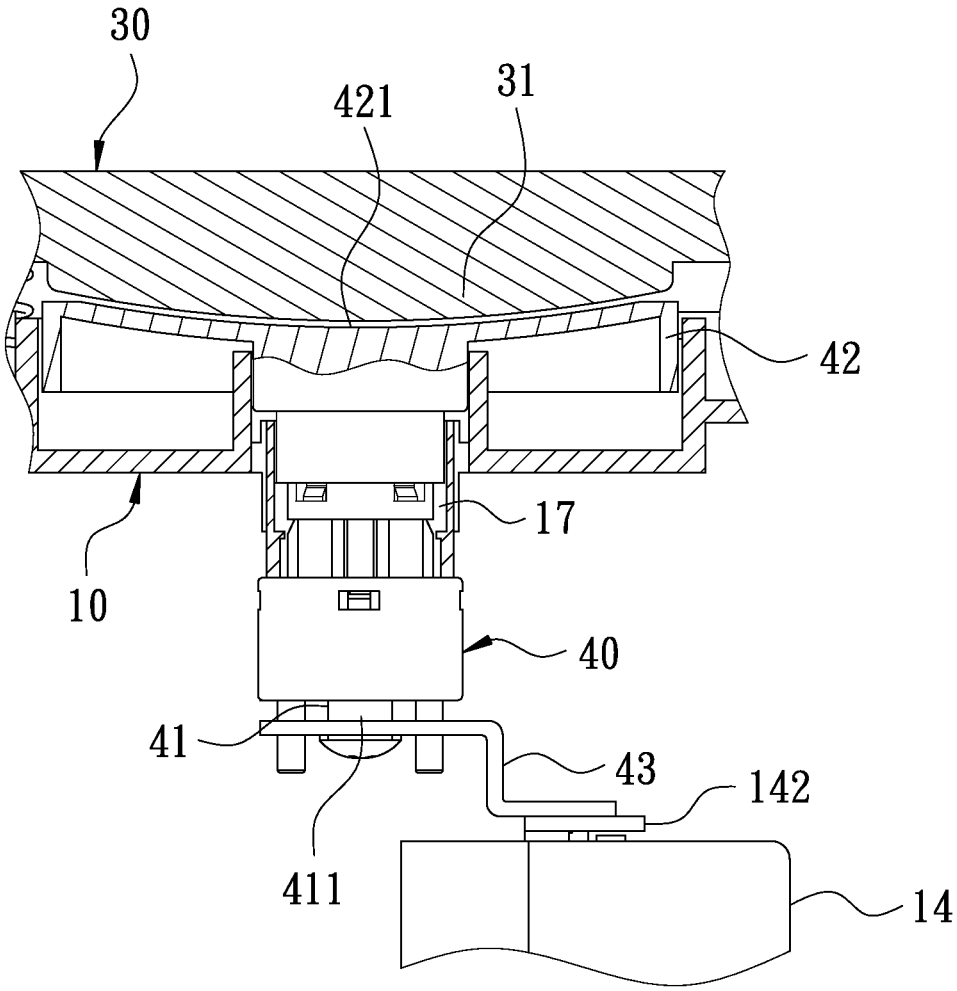
FIG. 6 is an enlarged sectional view showing the stop button to drive the stop portion of the switch member according to the preferred embodiment of the present invention.

The stop button 40 is disposed in the accommodation trough 17. The stop button 40 comprises a guide rod 41 which is axially disposed relative to the through hole 18. One end of the guide rod 41 is formed with a press plate 42 facing the outer casing 30. The press plate 42 has a concave top surface 421 corresponding to and leaning against the protrusion 31, such that the guide rod 41 is connected with the outer casing 30. Another end of the guide rod 41 is defined as a positioning end 411. The positioning end 411 is located in the through hole 18 and connected with a stop member 43. The stop member 43 has one end which is located opposite to the guide rod 41 and selectively against the stop portion 142 of the switch member 14, so that the guide 41 is connected with the stop portion 142. As shown in FIG. 4, the guide rod 41 comprises a fixed toothed portion 44 on a side wall thereof, a block portion 45 below the fixed toothed portion 44, and a rotatable ring 46 between the fixed toothed portion 44 and the block portion 45. The rotatable ring 46 has a movable toothed portion 461 to engage with the fixed toothed portion 44. A spring 47 is provided between the block portion 45 and the accommodation trough 17 of the main body 10. An inner wall of the accommodation trough 17 of the main body 10 has a plurality of guide grooves 171 corresponding to the fixed toothed portion 44 and the movable toothed portion 461 and a positioning toothed portion 172 between every two of the guide grooves 171. The positioning toothed portion 172 is disposed close to an open end of the relative guide groove 171. Thus, the stop button 40 has a first position as shown in FIG. 4 and a second position as shown in FIG. 5. When the stop button 40 is located at the first position, the fixed toothed portion 44 and the movable toothed portion 461 will be in the guide grooves 171. The positioning end 411 of the guide rod 41 is received in the through hole 18, such that the stop member 43 won't drive the stop portion 142 of the switch member 14. When the stop button 30 is pressed the first time, the guide rod 41 will be moved outward toward the through hole 18, as shown in FIG. 5 and FIG. 6. The positioning end 411 is moved out of the through hole 18, and the stop member 43 is linked to move downward and to press the stop portion 142 of the switch member 14. The rotatable ring 46 is turned an angle for the movable toothed portion 461 to engage with the fixed toothed portion 172, such that the guide rod 41 won't be returned to its original position by the spring 47 and the stop button 40 has the second position.

The limit unit 50 is disposed at one side of the main body 10 close to the start button 20. The limit unit 50 comprises a lock set 50. One end of the lock set 51 is connected with a limit member 52. The lock set 51 is started with a key 53 to turn the limit member 52 to be located between the start button 20 and the start portion 141 of the switch member 14, such that the start button 20 cannot start the start portion 141.

Referring to FIG. 3, FIG. 4, FIG. 5 and FIG. 6, the button switch 100 is mounted on an apparatus, such as a working machine, to start/stop the apparatus. In a normal state, the stop button 40 is located at the first position, as shown in FIG. 4, and doesn't drive the stop portion 142 of the switch member 14. Therefore, the operator can direct press the start button 20 to bring the start member 22 to press the start portion 141 of the switch member 14 downward to start the apparatus. When the operator wants to stop the apparatus, he/she can press the outer casing 30 downward to drive the stop button 40. At this time, the stop button 40 is moved from the first position to the second position as shown in FIG. 5. The stop member 43 presses the stop portion 142 of the switch member 14 to stop the apparatus. In the meanwhile, the movable toothed portion 261 engages with the fixed toothed portion 172. Thus, the guide rod 41 cannot be returned to the first position by the spring 47, and the stop member 43 continuously presses the stop portion 142 of the switch member 14 to limit the start portion 141, so that the switch member 14 cannot be started. When there is an emergency for the apparatus to be maintained, the operator won't touch the start button 20 unexpectedly to start the apparatus, providing a protection to the apparatus and the operator. When the operator wants to start the apparatus again, he/she just presses the outer casing 30 again to drive the stop button 40. The rotatable ring 36 will be driven by the fixed toothed portion 44 to move downward and guided by the positioning toothed portion 172 to be in guide grooves 171 again. The guide rod 41 is moved upward by the elasticity of the spring 47, and the stop button 40 is returned to the first position, namely, the start button 20 can start the switch member 14 again. It is noted that when there is an emergency, the operator is always flurried and cannot press the outer casing 30 exactly. Through the protrusion 31 of the outer casing 30 and the concave top surface 421 of the stop button 40, the stop button 40 can be pressed to drive the stop portion 142 of the switch member 14 even though only a portion of the outer casing 30 is pressed. This can avoid any accidents caused by the reason that the operator doesn't press the outer casing 30 exactly.

Figure 7:
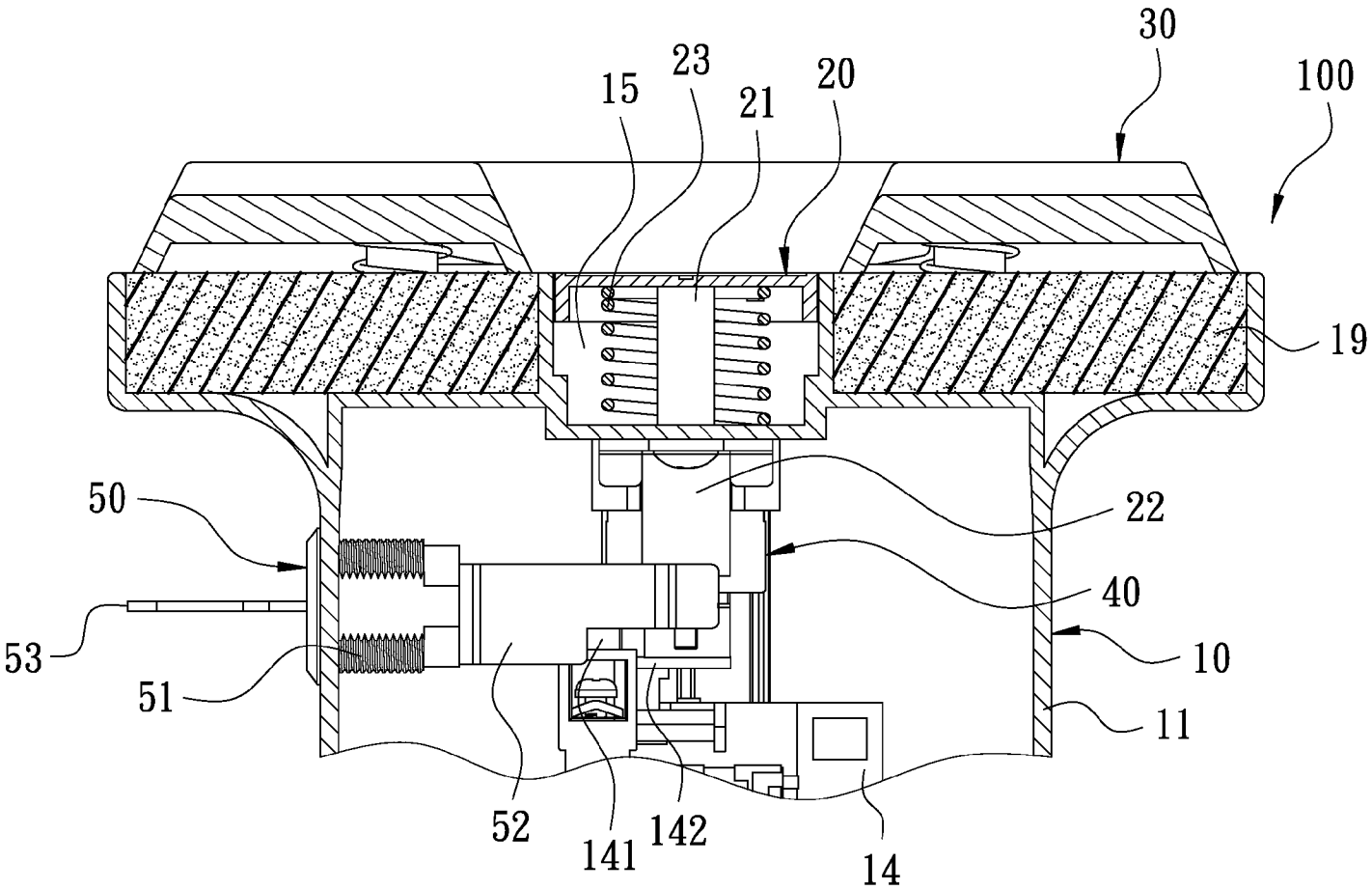
FIG. 7 is an enlarged sectional view showing the limit unit before operated according to the preferred embodiment of the present invention.
Figure 8:
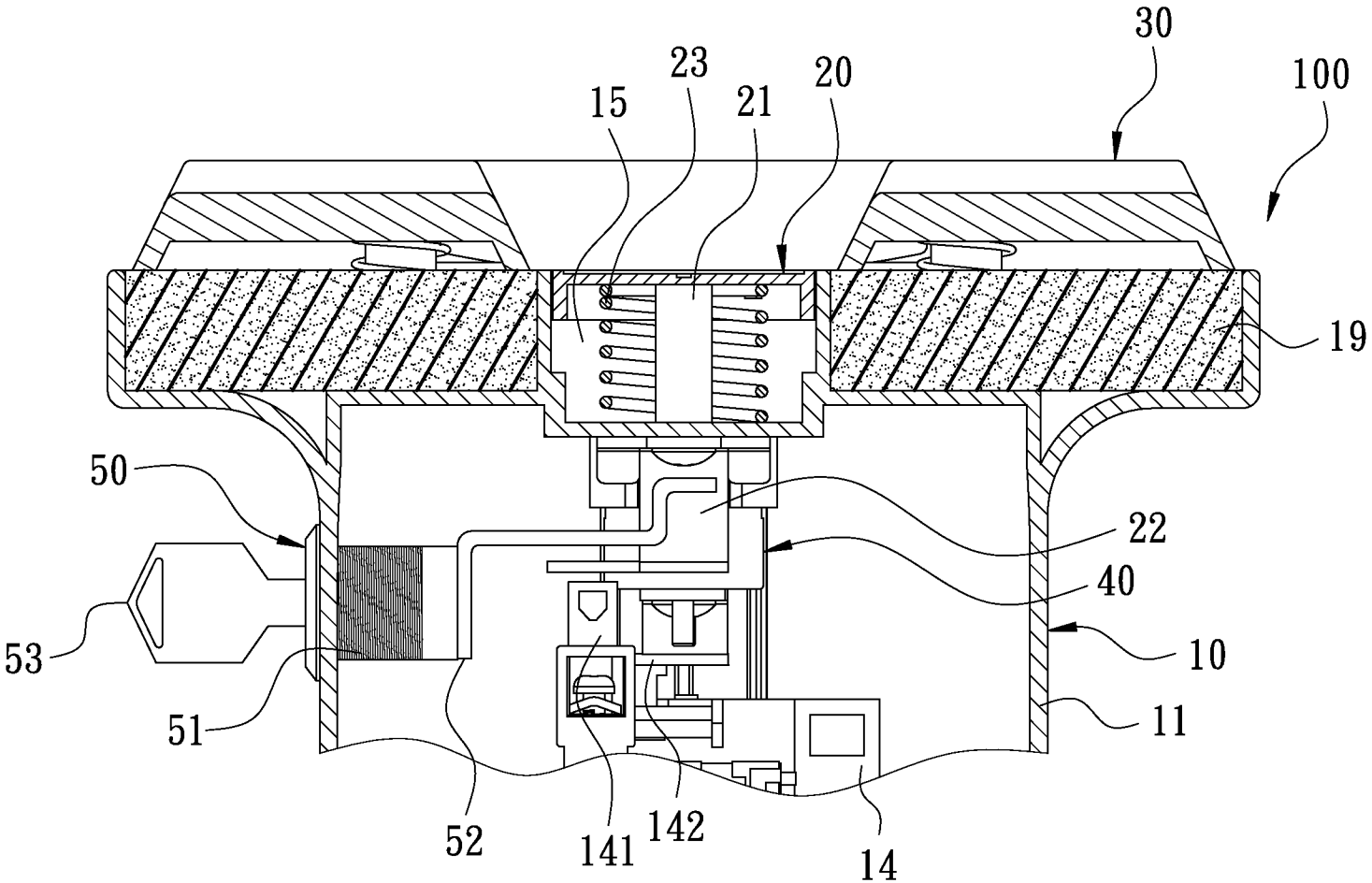
FIG. 8 is an enlarged sectional view showing the limit unit after operated according to the preferred embodiment of the present invention.

FIG. 7 and FIG. 8 are schematic views showing the limit unit according to the preferred embodiment of the present invention. Through the limit unit 50, the operator can turn the lock set 51 with the key 53 after the start button 20 is pressed. The limit member 52 is turned to be located between the start button 20 and the start portion 141 of the switch member 14, so that the start button 20 cannot start the start portion 141. Thus, after the apparatus is stopped, a person who is familiar with the button switch 100 of the present invention cannot restart the apparatus unintentionally, providing a dual-protection effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A button switch, comprising:

a main body comprising a switch member, the switch member having a start portion and a stop portion;

a start button disposed on the main body to drive the start portion;

a stop button disposed on the main body to drive the stop portion, wherein the stop button has a first position and a second position, in a normal state, the stop button is located at the first position and doesn't drive the stop portion, when the stop button is pressed the first time, the stop button is moved from the first position to the second position to drive the stop portion, when the stop button is pressed the second time, the stop button is returned to the first position;

the main body further comprises an outer casing on top of the stop button, the outer casing has a bottom provided with a plurality of circular poles, and each of the circular poles is fitted with a spring and elastically against the stop button; and the bottom of the outer casing is provided with a protrusion which is disposed close to the stop button, a top end of the guide rod is formed with a press plate, and the press plate has a concave top surface corresponding to the protrusion.

2. The button switch as claimed in claim 1, wherein the main body further has an accommodation trough at a central portion thereof and a through hole in a bottom of the accommodation trough, the stop button being accommodated in the accommodation through, the stop button comprising a guide rod which is axially disposed relative to the through hole and received in the accommodation trough, one end of the guide rod being defined as a positioning end, the positioning end being located in the through hole, the guide rod comprising a fixed toothed portion on a side wall thereof, a block portion below the fixed toothed portion and a rotatable ring between the fixed toothed portion and the block portion, the rotatable ring having a movable toothed portion to engage with the fixed toothed portion, a spring provided between the block portion and the accommodation trough of the main body, an inner wall of the accommodation trough of the main body having a plurality of guide grooves corresponding to the fixed toothed portion and the movable toothed portion and a positioning toothed portion between every two of the guide grooves, the positioning toothed portion being disposed close to an open end of the relative guide groove, thereby, when the stop button is located at the first position, the fixed toothed portion being located in the guide grooves and the positioning end of the guide rod being received in the through hole, when the stop button is pressed the first time, the guide rod being moved outward toward the through hole, the positioning end being moved out of the through hole, the rotatable ring being turned an angle for the movable toothed portion to engage with the fixed toothed portion, such that the guide rod won't be returned to its original position by the spring and the stop button has the second position.

3. The button switch as claimed in claim 1, wherein the main body comprises an upper part, a lower part and a chamber between the upper part and the lower part to accommodate the switch member.

4. The button switch as claimed in claim 3, wherein the main body further comprises a seal ring at the junction of the upper part and the lower part.

5. The button switch as claimed in claim 1, wherein the start button is disposed on top of the main body, the start button has a bottom connected with a start member, and the start member has one end which is located opposite to start button and against the start portion.

6. The button switch as claimed in claim 1, wherein the stop button is disposed on the top of the main body, the stop button has a bottom connected with a stop member, and the stop member has one end which is located opposite to the stop button and selectively against the stop portion.

7. The button switch as claimed in claim 1, wherein the main body further comprises a limit unit, the limit unit comprises a limit member which is rotatable, the limit member is turned an angle to be located between the start button and the start portion of the switch member, such that the start button is unable to start the start portion.

8. The button switch as claimed in claim 7, wherein the limit unit comprises a lock set, the lock set is connected with the limit member, and a key is used to unlock the lock set for driving the limit member.

* * * * *

UNITED STATES PATENT AND TRADEMARK OFFICE

CERTIFICATE OF CORRECTION

PATENT NO. : 8,541,708 B2
APPLICATION NO. : 13/039439
DATED : September 24, 2013
INVENTOR(S) : Christian Chenier It is certified that error appears in the above-identified patent and that said Letters Patent is hereby corrected as shown below:

On the Title Page, Item (73)

the "Assignee: General International Mfg (Co) Ltd., Quebec (CN)" should read
--- Assignee: General International Mfg (Co) Ltd., Quebec (CA) ---

Signed and Sealed this
Eleventh Day of March, 2014

Michelle K. Lee

Michelle K. Lee
*Deputy Director of the United States Patent and Trademark Office*